US005954043A

United States Patent [19]

Mayville et al.

[11] Patent Number: 5,954,043

[45] **Date of Patent: *Sep. 21, 1999**

[54] LESS LETHAL WEAPON ATTACHABLE TO LETHAL WEAPON INCLUDING VALVE ARRANGEMENT

[75] Inventors: Wayne R. Mayville, Phoenix; Thomas E. Wergen, Glendale, both of Ariz.

[73] Assignee: Universal Propulsion Company, Inc., Phoenix, Ariz.

[ * ] Notice: This patent issued on a continued prosecution application filed under 37 CFR 1.53(d), and is subject to the twenty year patent term provisions of 35 U.S.C. 154(a)(2).

[21] Appl. No.: 08/878,912

[22] Filed: Jun. 19, 1997

Related U.S. Application Data

[63] Continuation-in-part of application No. 08/683,323, Jul. 18, 1996, Pat. No. 5,832,911.

[51] Int. Cl.[6] ..... F41B 11/32

[52] U.S. Cl. ..... 124/75; 124/76

[58] Field of Search ..... 89/7; 124/70, 71, 124/73, 74, 75, 76

[56] References Cited

U.S. PATENT DOCUMENTS

| | | | |
|---|---|---|---|
| 4,344,410 | 8/1982 | Curran | 124/74 |
| 4,936,282 | 6/1990 | Dobbins et al. | 124/74 |
| 5,257,614 | 11/1993 | Sullivan | 124/73 |
| 5,280,778 | 1/1994 | Kotsiopoulos | 124/73 |
| 5,383,442 | 1/1995 | Tippmann | 124/76 |

*Primary Examiner*—Stephen M. Johnson
*Attorney, Agent, or Firm*—Pennie & Edmonds LLP

[57] ABSTRACT

A weapon comprising a combination lethal weapon and less lethal gas-powered weapon mounted below the lethal weapon. The less lethal weapon which fires projectiles is independently operable when dismounted and included bolt, gas supply and magazine features.

20 Claims, 11 Drawing Sheets

LESS LETHAL WEAPON ATTACHABLE TO LETHAL WEAPON INCLUDING VALVE ARRANGEMENT

RELATED APPLICATION

This application is a continuation-in-part of U.S. patent application Ser. No. 08/683,323 filed Jul. 18, 1996 entitled "Less Lethal Weapon Attachable To Lethal Weapon" now U.S. Pat. No. 5,832,911.

BACKGROUND OF THE INVENTION

Numerous attachments to rifles have been proposed including grenade and non-lethal launchers attachable to the rifle muzzle (U.S. Pat. Nos. 4,154,012 and 4,270,293) or the underside of the weapon (U.S. Pat. No. 3,442,173). Less than lethal liquid filled balls have also been proposed to be propelled from a barrel extension (U.S. Pat. No. 3,791,303).

Non lethal projectile units including a projectile and propelling charge have been described (U.S. Pat. No. 3,733,727). Paint ball guns with bulk loaders are known (U.S. Pat. No. 5,282,454).

Under barrel rifle mounts have been proposed for grenades and flare launching (U.S. Pat. No. 5,198,600). Air powered paint ball pistols using liquid $CO_2$ have also been described (U.S. Pat. No. 5,462,042) and gas powered pistols have included flow values and bolt actuators (U.S. Pat. No. 5,280,778).

SUMMARY OF THE INVENTION

Broadly, the present invention is a less lethal projectile launching weapon for discharging projectiles, pellets or other antipersonnel objects used in combination with a lethal weapon or independently. The less lethal mechanism can be attached to a lethal firearm or used as a separate stand-alone weapon.

The weapon includes a novel gas pressure providing system, a novel magazine loading system including a turnable barrel, an improved bolt arrangement and a bleed valve. Further, a novel projectile is utilized by the weapon.

DESCRIPTION OF THE PREFERRED EMBODIMENT

With respect to FIGS. 1–4, dual weapon unit 5 includes lethal weapon 6 and less lethal weapon 7 mounted below weapon 6. Weapon 6 includes a barrel, a trigger, a magazine and all necessary components to be a stand-alone weapon.

Figure 1:
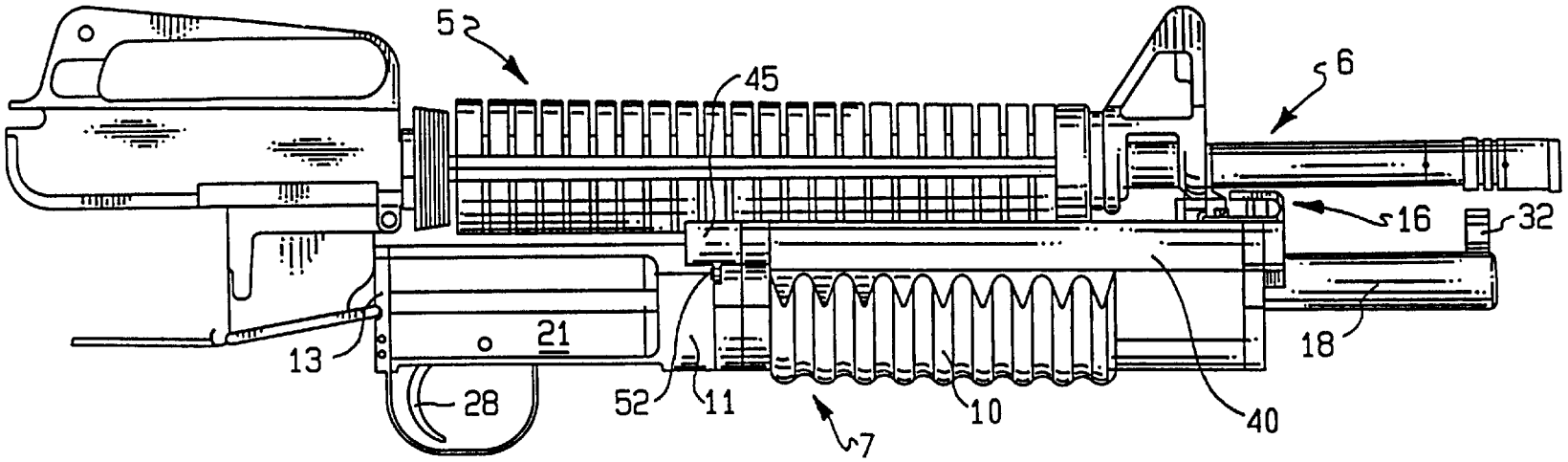
FIG. 1 is a side elevational view of a lethal firearm with an attached less lethal weapon of the present invention.
Figure 1A:
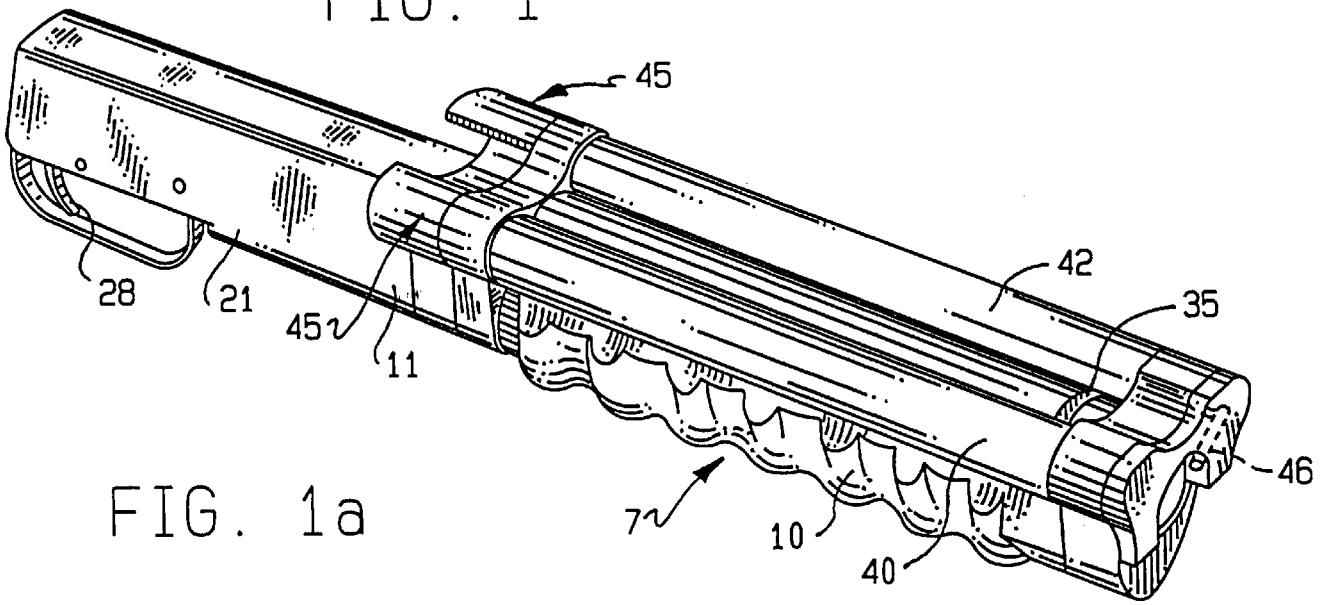
FIG. 1*a* is a perspective view of the less lethal weapon detached from the lethal weapon with the barrel removed.
Figure 2:
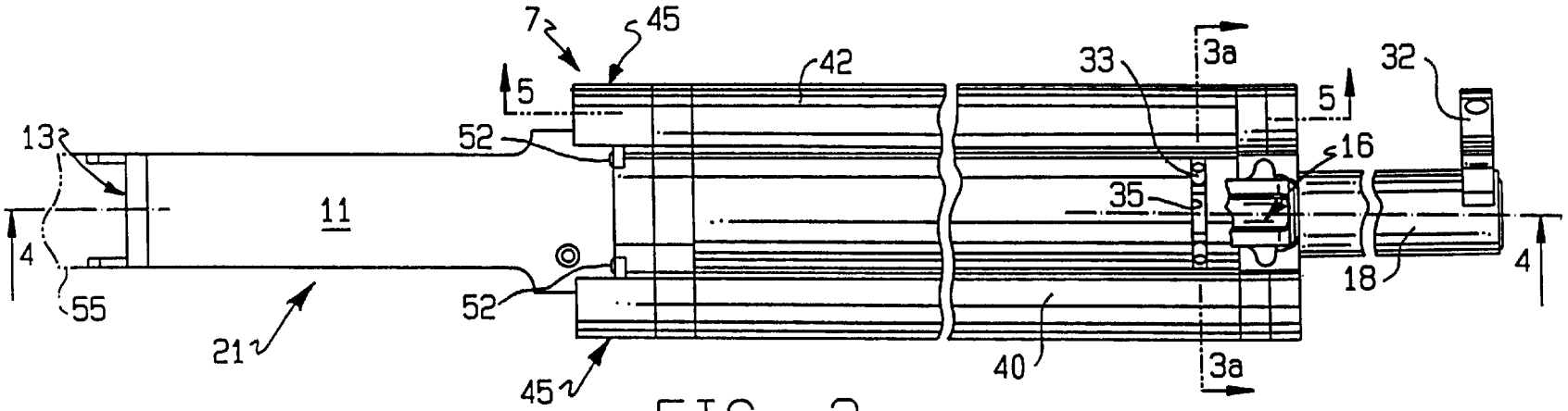
FIG. 2 is a plan view of the less lethal mechanism showing the barrel turning mechanism.
Figure 4:
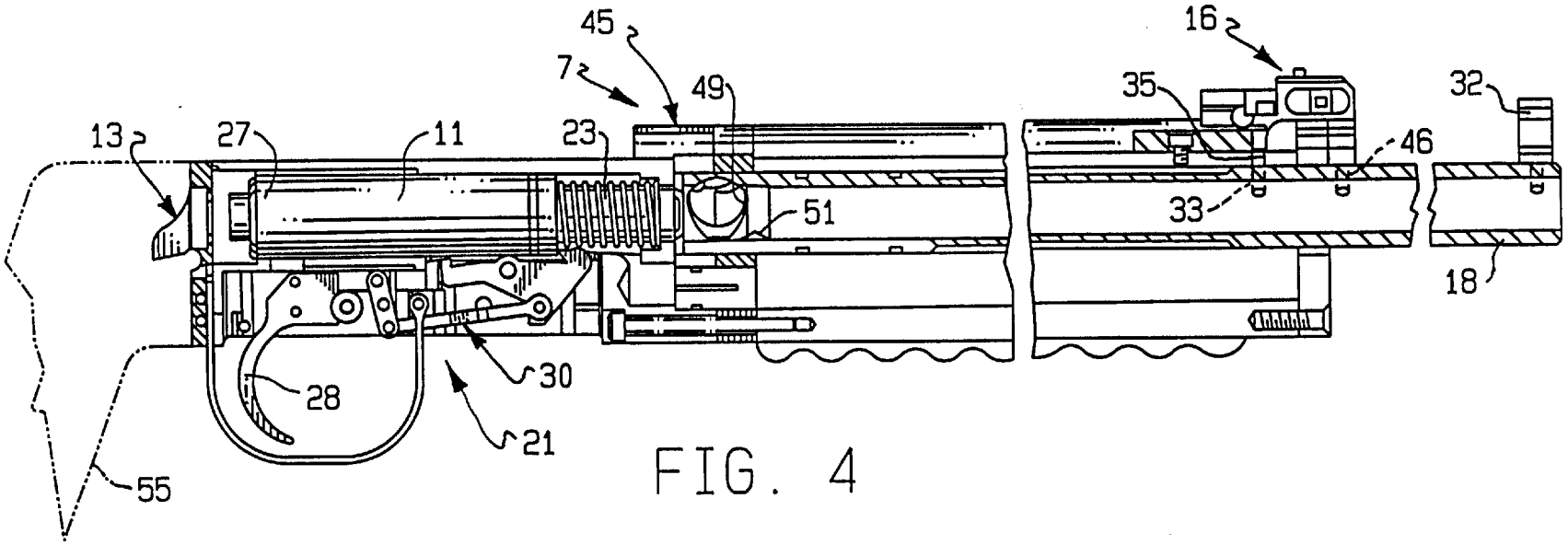
FIG. 4 is a longitudinal sectional view along line 4—4 of FIG. 2.
Figure 3A:
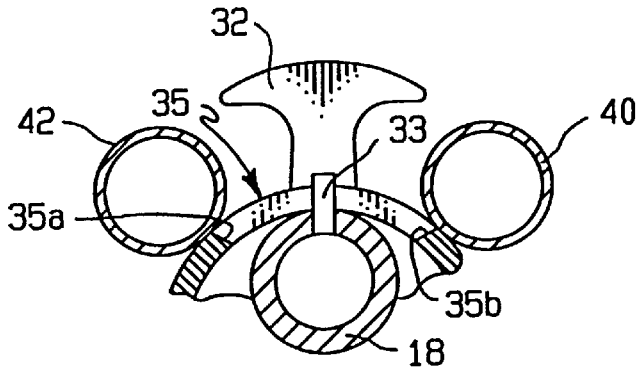
FIG. 3*a* is a sectional view taken along line 3*a*—3*a* of FIG. 2.
Figure 3B:
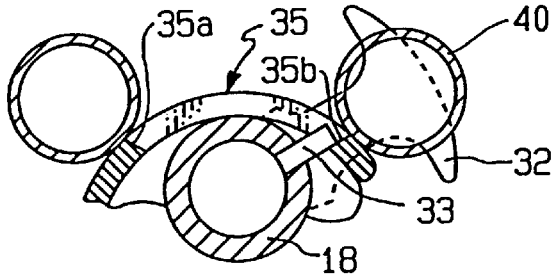
FIGS. 3*b* and 3*c* are similar to FIG. 3*a* showing the barrel turned left and right.
Figure 3C:
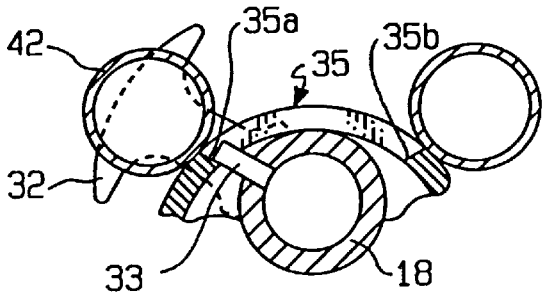

Projectile launching weapon mechanism 7 includes frame 11, mount brackets 13 and 16 for mounting mechanism 7 on lethal weapon 6, barrel 18, receiver 21 (including bolt 23), gas valve section 27, trigger 28 and trigger mechanism 30 (FIG. 4). With particular reference to FIGS. 2, 3*a*–3*c* and 4, barrel 18 has a forward handle 32 for turning barrel 18 from a first position in which barrel 18 is supplied by magazine 40 (FIG. 3*b*) to a second position in which barrel 18 is supplied by magazine 42 (FIG. 3*c*). Barrel 18 carries a projecting pin 33 which rides in arcuate frame groove 35. Groove 35 has stop ends 35*a*, 35*b*. Barrel 18 is turned until pin 33 either engages stop 35*b* in FIG. 3*b* or stop 35*a*. Less lethal weapon 7 further includes two projectile magazines 40, 42 and grip 10 (FIG. 1*a*).

Figure 5:
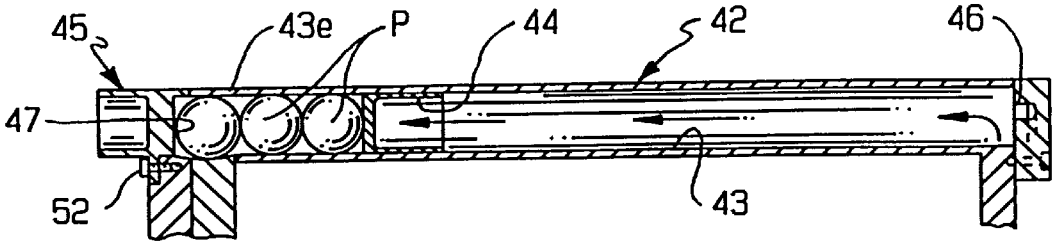
FIG. 5 is a sectional view along line 5—5 of FIG. 2.
Figure 7A:
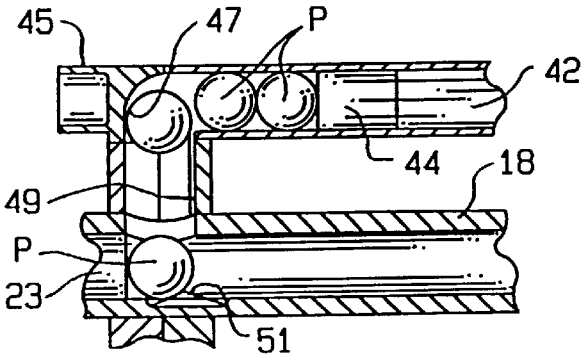
FIG. 7*a* is a partial side elevational view of a projectile exiting a magazine into the barrel.
Figure 7B:
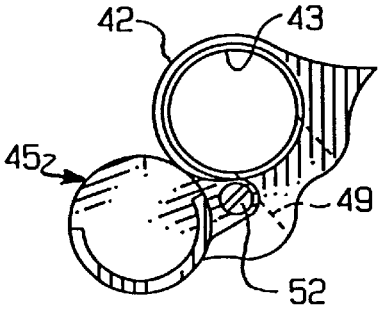
FIG. 7*b* is an end view of the magazine with the loading door open.

Turning to FIGS. 5, 7 and 7*a*, magazine 42 includes projectile storage tube 43 and plastic slidable piston 44 to urge the projectiles (P) toward magazine loading door 45 and adjacent loading shoot 49. When the weapon is fired, a portion of the gases propelling projectile (P) are diverted out a hole in barrel 18 (not shown) which is aligned with passage 46 leading to magazine tube 43. Gases do not flow until projectile (P) passes the hole in the barrel in its travel out the end of barrel 18. Gas pressure in tube 43 urges piston 44 toward the tube end 43e which is comprised of a cam surface 47 on the interior of loading door 45. When projectile (P) is urged against cam surface 47 the projectile is caused to turn at right angles into projectile loading shoot 49 (see FIG. 7*a*) and then into barrel 18 where the projectile rests against spring 51. Spring 51 prevents projectile (P) from exiting barrel 18 prior to firing. Magazine 40 is similarly constructed and is served by barrel gases through a passage similar to passage 46 (not shown) when barrel 18 is turned aligning barrel hole with such similar passage. FIG. 7*b* shows loading door 45 swung open about hinge 52 for loading.

Projectile launching weapon 7 is a complete weapon in that it can be fired attached to weapon 6 or can be detached and used independent of weapon 6. When detached, weapon 6 is readily provided with grip 55 after removal of receiver mount bracket 13 (FIGS. 2 and 4).

Figure 6:
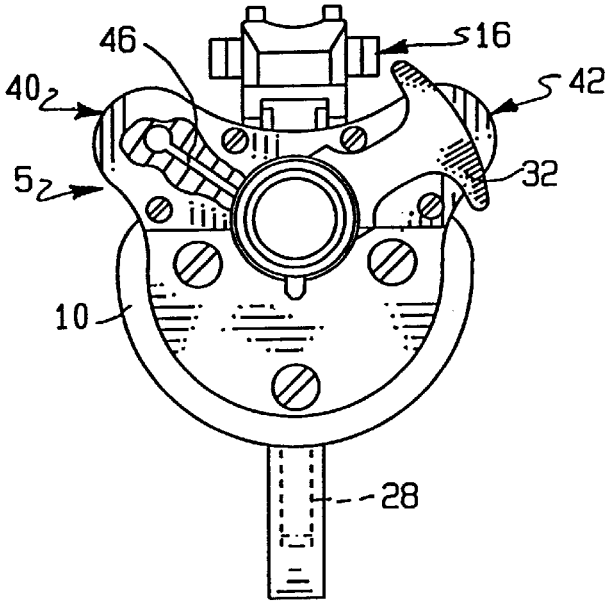
FIG. 6 is a front elevational view of the weapon.
Figure 8:
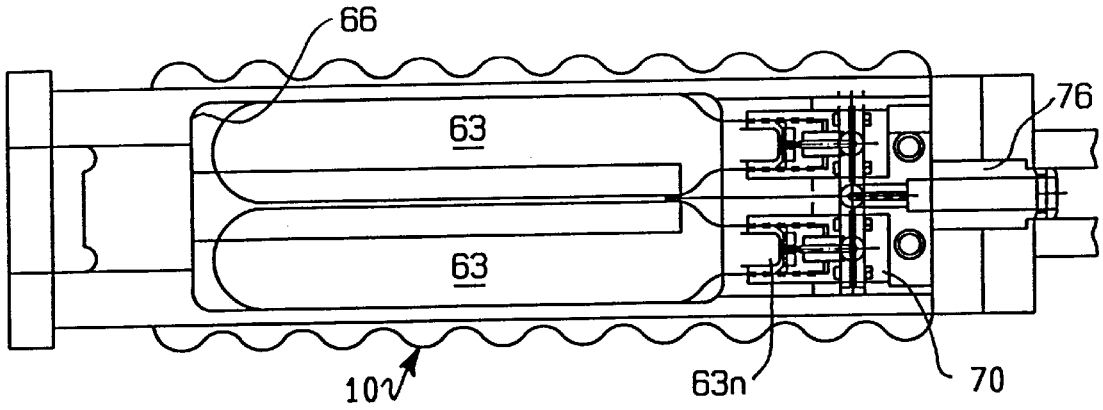
FIG. 8 is a bottom view of the weapon showing the gas bottle storage with the door removed.
Figure 9:
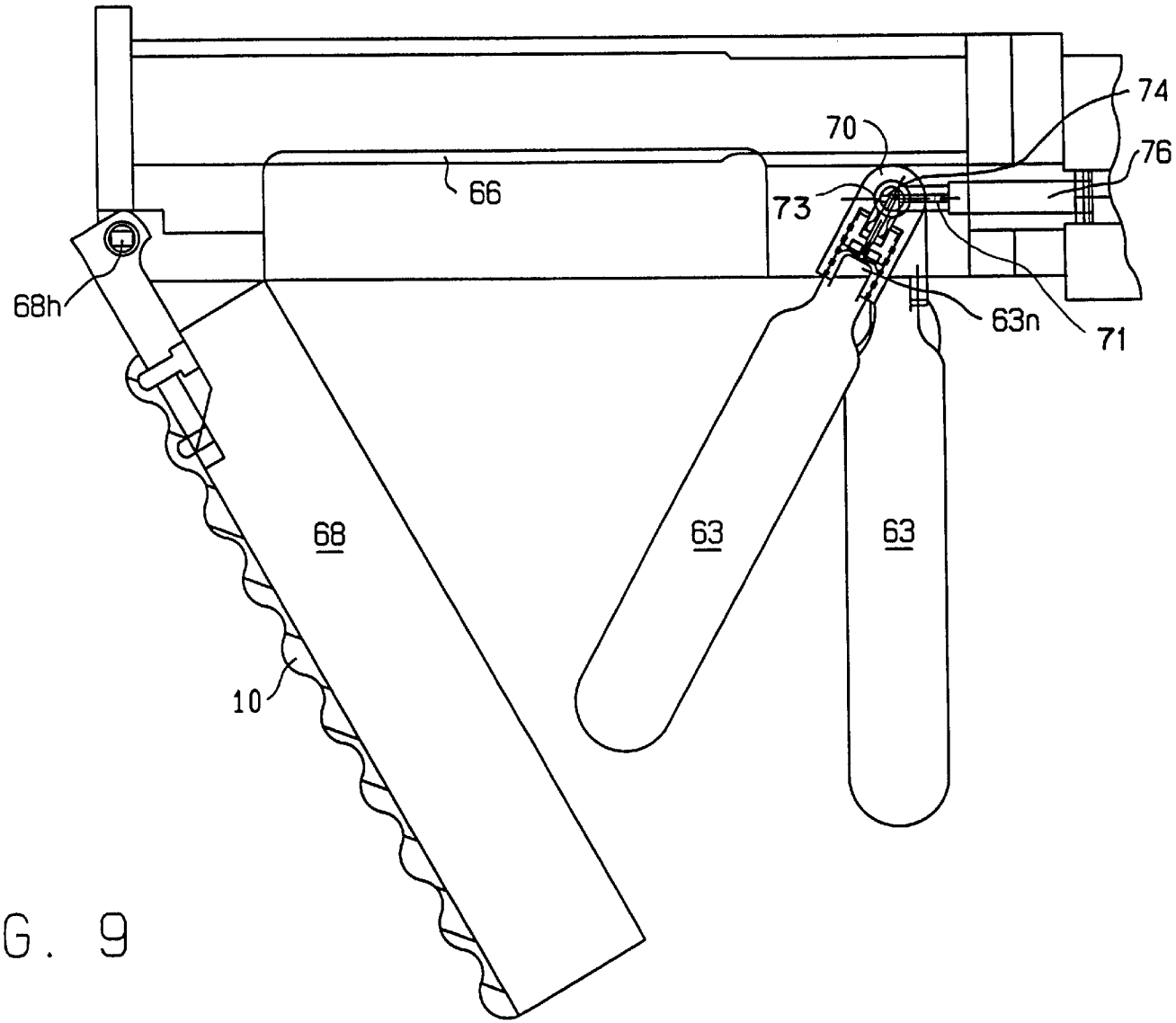
FIG. 9 is a side elevational view of a gas storage door open and a bottle attached and ready to be stowed.

Turning to FIGS. 6, 8 and 9, gas supply units 60, 62 each include one bottle 63 housed in a compartment 66 having a door 68. To install bottles 63 in compartment 66, bottle 63 with its threaded neck 63n is screwed into swingable bottle support 70. Support 70 includes a bottle piercer 71 and a curved neck end 73 which end 73 is in gas-sealed contact with the arcuate surface of conduit 74. When bottle 63 is screwed on to threaded support 70 the bottle seal is pierced but gas does not flow into conduit 74 until bottle 63 is swung to a horizontal position which positioning allows bottle gas to communicate with an opening in conduit 74. Conduit 74 in turn communicates with gas pipe 76. Compartment door 68 includes hinge 68*h*.

Figure 10:
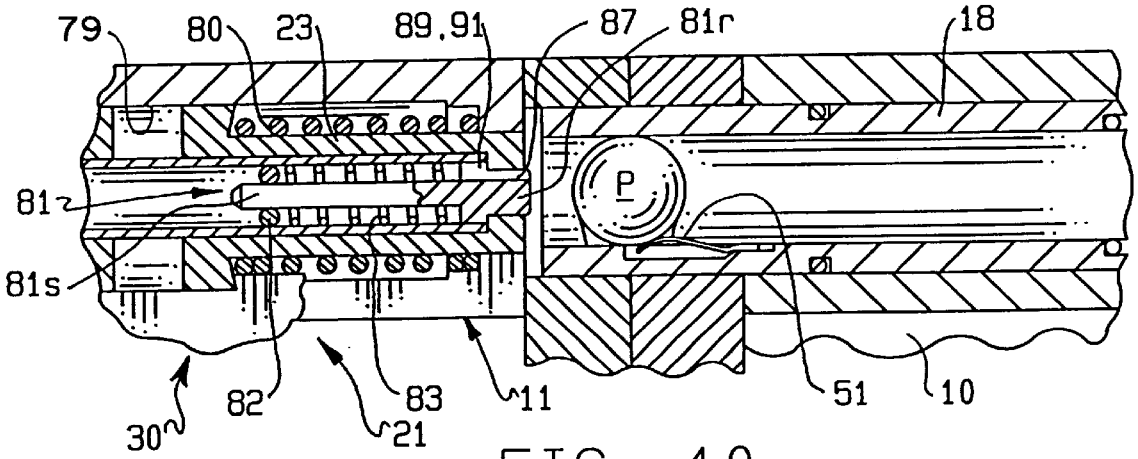
FIG. 10 is a side elevational view of the bolt in ready-to-fire position.
Figure 11:
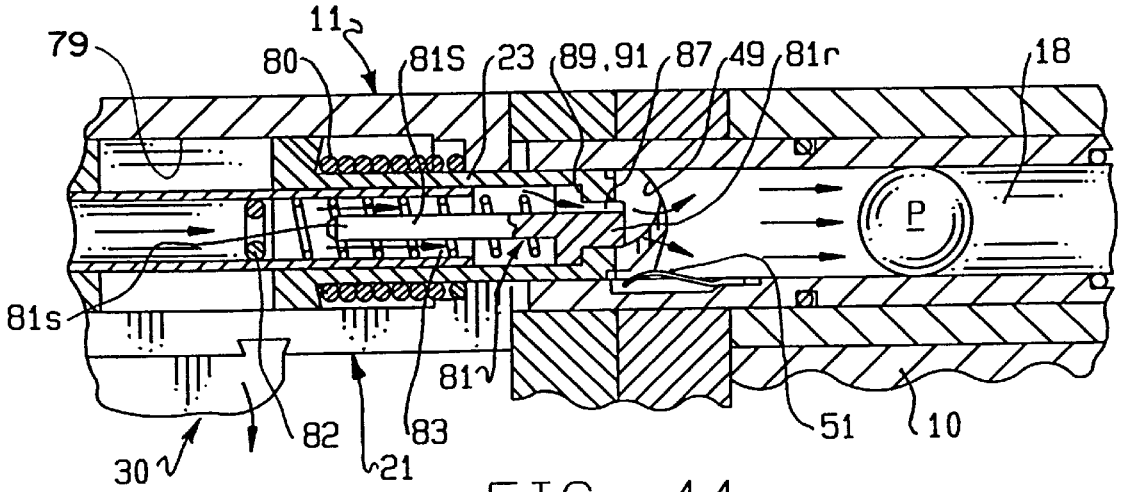
FIG. 11 is a side elevational view of the bolt on its full forward position after firing.
Figure 12:
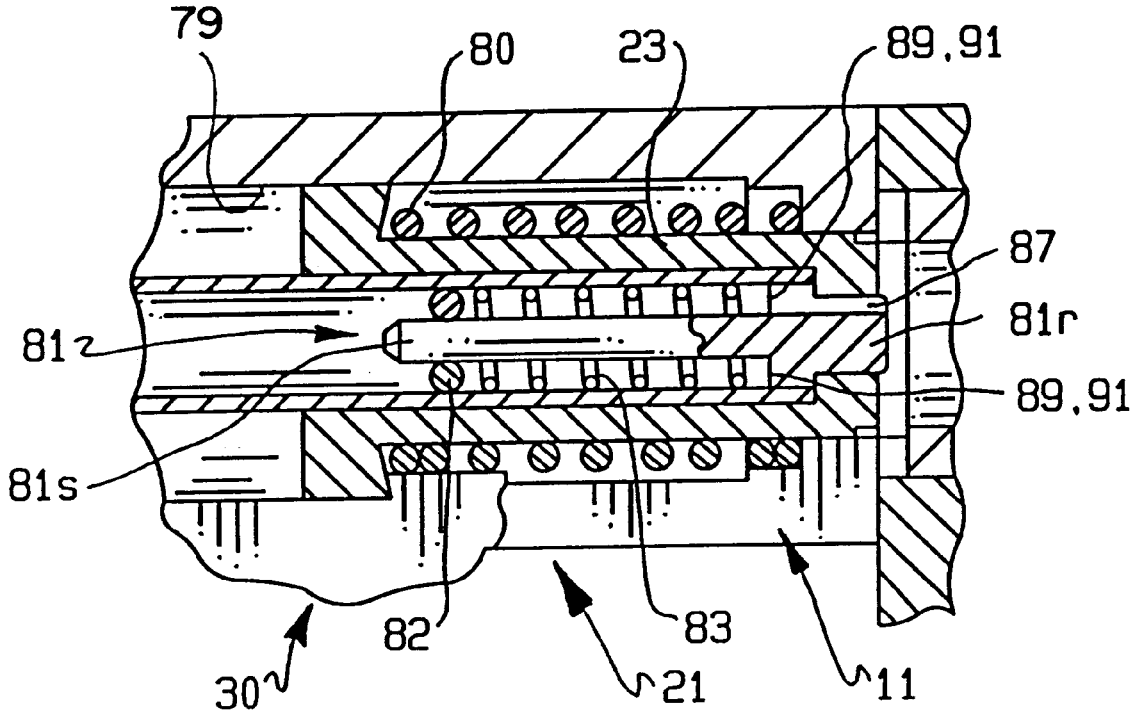
FIG. 12 is an enlarged portion of FIG. 10 showing the piston in the bolt.
Figure 13:
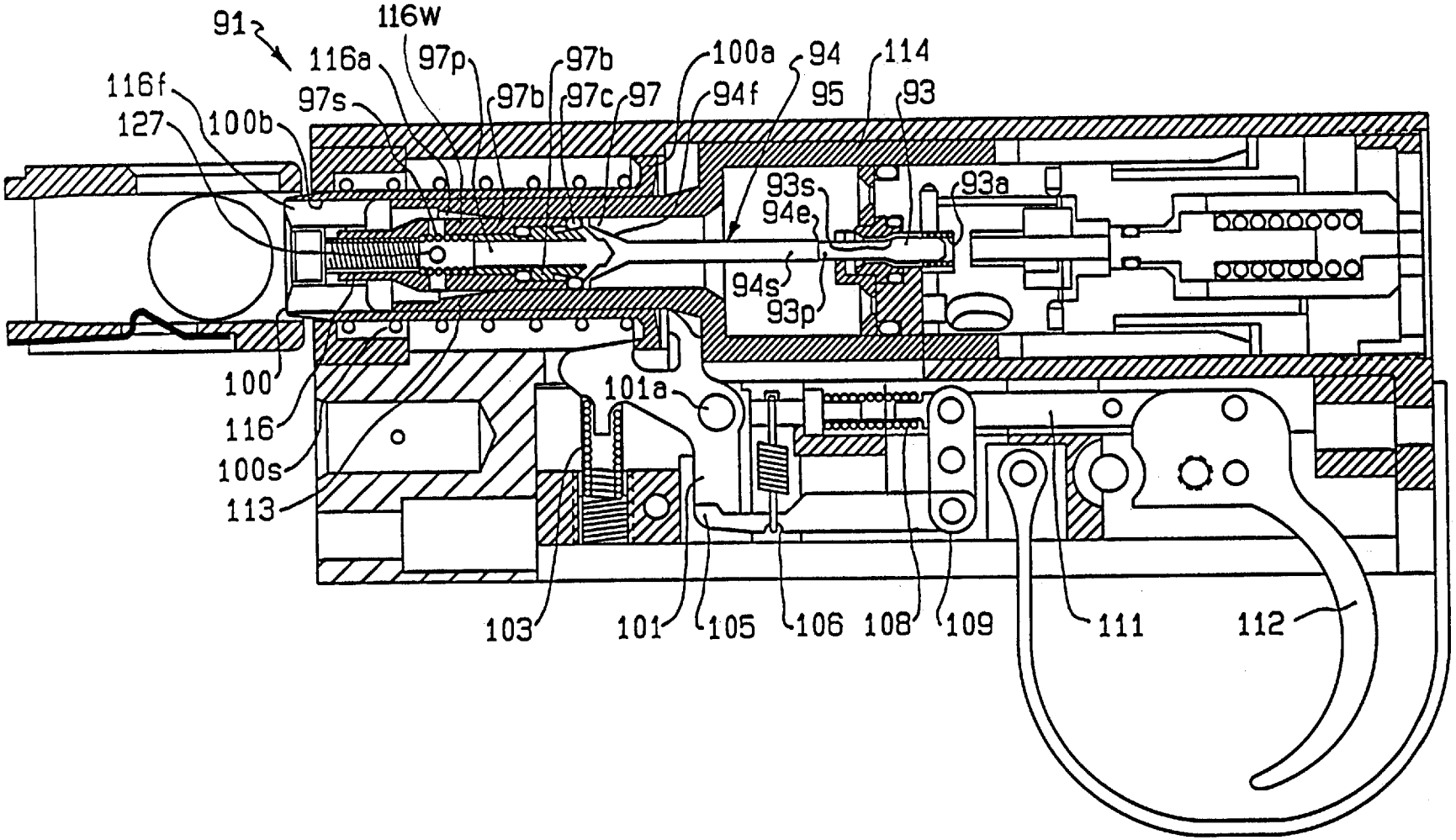
FIG. 13 is an elevational view of another embodiment of the invention with the weapon in its ready-to-fire mode.
Figures 14, 14A:
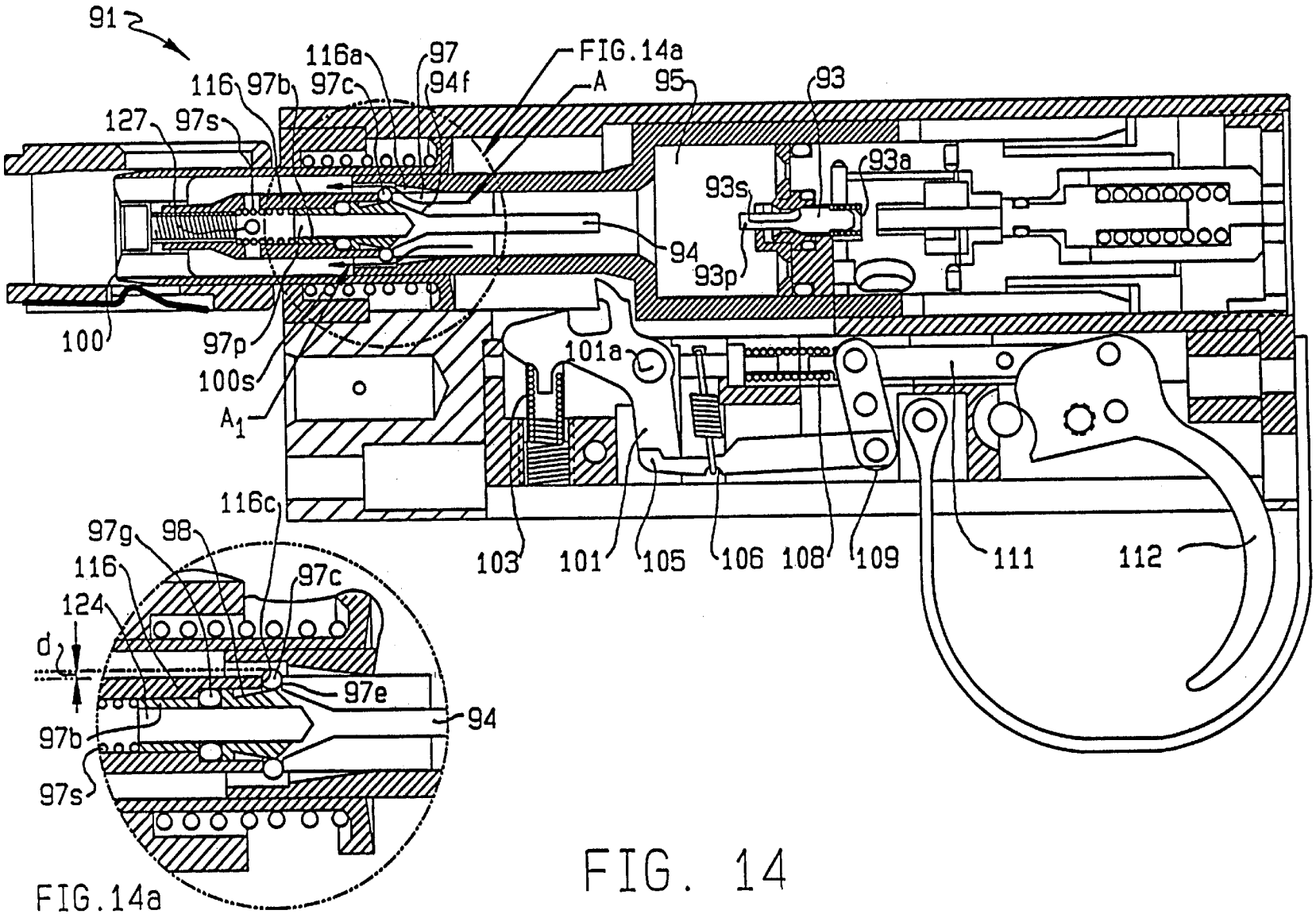
FIG. 14 is a view similar to FIG. 13 in which the weapon bolt is in a forward position during the firing cycle.
FIG. 14*a* is an enlarged circled portion of FIG. 14.
Figures 15, 15A:
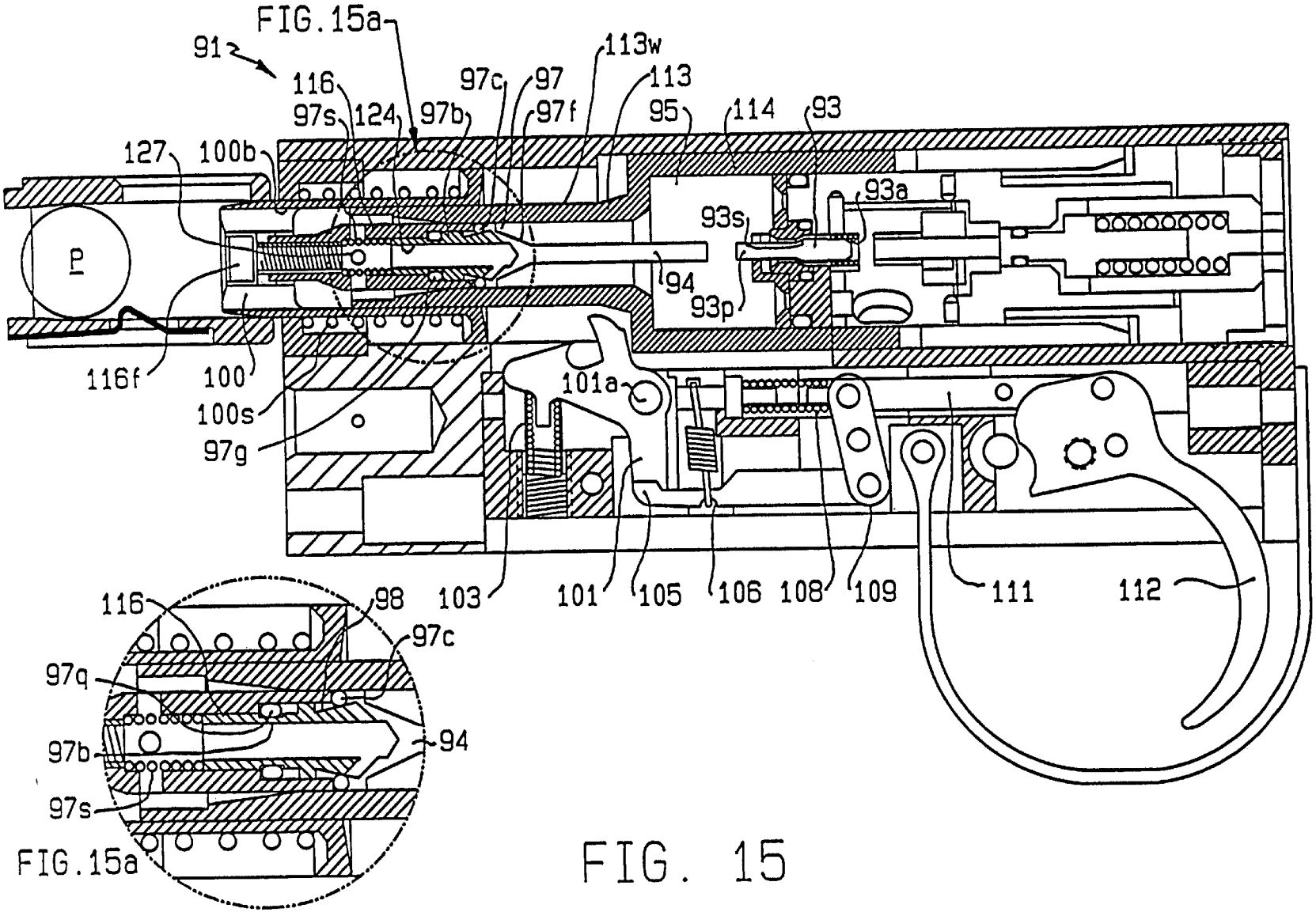
FIG. 15 is a similar view to FIG. 13 with the weapon bolt in a partially returned position.
FIG. 15*a* is an enlarged circled portion of FIG. 15.
Figure 16:
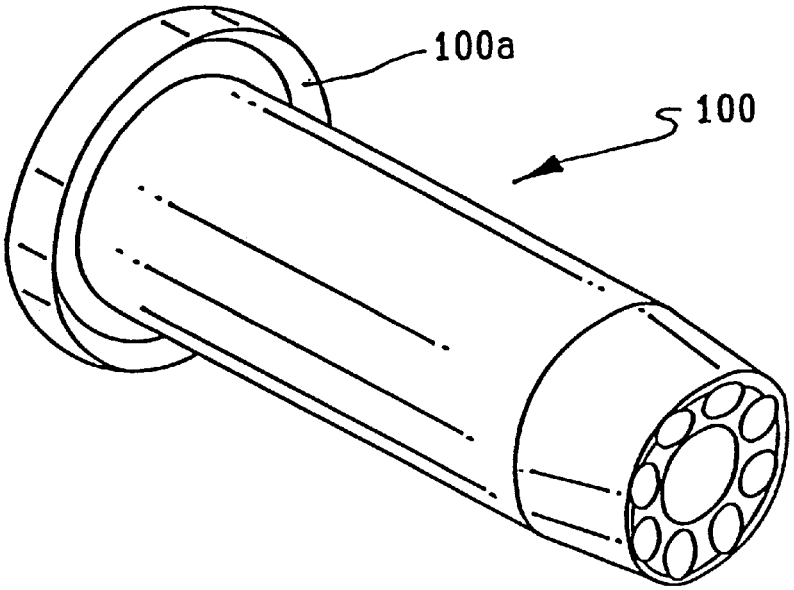
FIG. 16 is a perspective view of the bolt of the weapon.
Figure 17A:
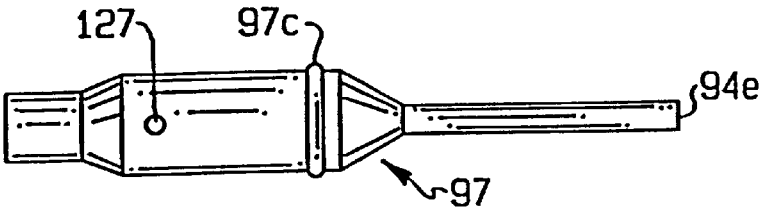
FIG. 17*a* is a plan view of the bolt piston and bleeding valve actuator in the bleed valve closed position.
Figure 17B:
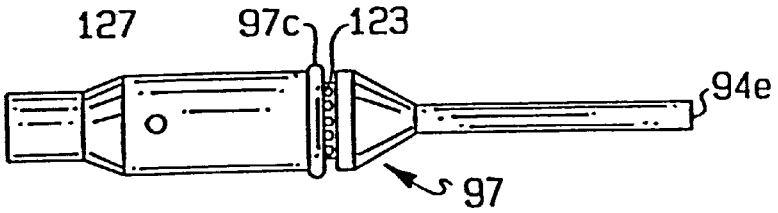
FIG. 17*b* is a view similar to FIG. 17*a* with the bleed valve in the open position.

Finally turning to FIG. 10–12, reciprocal bolt 23 is housed in receiver 21 and guided by interior tube 79. Bolt return coil spring 80 urges bolt 23 to the left. Connected to bolt is piston 81 which is sealed by o-ring 82 which o-ring 82 is held in place by o-ring spring 83. When gas valve 27 is activated, gas pressure acting on piston 81 causes piston 81 (and connected bolt 23 which is connected by welding, brazing or otherwise) to move to the right. After limited movement of bolt/piston to the right, piston 81 exits o-ring 82 allowing gases to flow around piston 81 through piston channel 87*s* (FIG. 11). Bolt 23 and its piston 81 strike projectile (P) and simultaneously gases flow through channels 87. The bolt/piston and gases together propel projectile (P) down and out barrel 18.

Piston 81 included stem 81s and enlarged restraint section 81*r* which includes restraint shoulder area 89. Shoulder area 89 abuts in surface-to-surface engagement bolt tip area 91 to prevent piston 81 from separating from bolt 23 and exiting down barrel 18.

Projectiles may be hard or soft rubber, liquid or gel-filled "capsules". Dye filled tear gas, pepper or other incapacitating agents may be used. Projectiles (P) may have dimples in their surfaces to improve their aerodynamic characteristics. Projectiles made of Norsorex® brand polynorbornene or similar type materials are preferred. Polynorbornene material is not resilient and therefore causes the body of the person being struck by the projectile to absorb the energy of the moving projectile. Such materials also have good thermal qualities in that they operate well in cold weather. The projectile may have a dimpled surface to improve its flight characteristics.

The lack of resilience of a projectile including polynorbornene and carbon is shown by the following drop test in which a spherical projectile 0.644 inches in diameter was dropped from various heights onto a ¾" plywood board two (2) feet by two (2) feet square and the height of the projectile rebounded was observed and measured:

TABLE 1

| | Height of Drop | Height of Rebound |
|---|---|---|
| Run 1 | 30 inches | 2-1/2" |
| Run 2 | 60 inches | 3-3/4" |
| Run 3 | 90 inches | 3-5/8" |

The percent rebound or bounce factor for each run is:

$$\text{Run 1} \quad \frac{2.5}{30} = .083 \text{ factor}$$

-continued $$\text{Run 2} \quad \frac{3.25}{60} = .054 \text{ factor}$$

$$\text{Run 3} \quad \frac{3.625}{90} = .040 \text{ factor}$$

The projectile balls utilized in the above test conformed to ASTM D2000 MAA 506; 50±shore A which designates the material characteristic of the ball. However, any alternate material so composed to provide minimal rebound upon impact may also be utilized. While test runs show bounce factors in the 0.040 to 0.083 range, balls with bounce factors between 0.010 and 0.100 may be used.

When the inelastic ball of the present invention strikes an object such as a person, it absorbs the energy of deformation in its complex molecular structure. Since the deformation is not permanent, the energy of deformation is released at a rate that does not impart the typical rubber ball rebound. During such period of energy release the ball is still in contact with the human it struck. This causes the sensation of pain from the physical contact to be extended and therefore more noticed. During such extended period of time the ball is still moving and therefore is disturbing more subcutaneous tissue than that which would occur with a normal elastic ball. Deeper ball penetration, without penetrating through the skin, but only moving it, involves more receptors increasing the sensation of pain to the person.

Because mechanical work is defined as work equals force times the distance through which it operates, the longer period of contact allows more work too be performed by the ball upon the body. This work is shown in two ways. First by subcutaneous damage and more importantly, by movement of the body as a whole. It is therefore probable that a person so struck may not be able to keep his upright position.

In the operation of the less-than-lethal weapon 7, loaded gas bottles 63 are installed by engaging neck end 73 with swingable bottle supports 70 (FIG. 9). Bottles 63 together with supports 70 are swung into compartment 66 and door 68 is closed. The swinging of bottles 63 causes gases to enter gas pipe 76 which communicated with gas valve 27 (FIG. 4).

Next, projectiles (P) are loaded in magazines 40,42 through magazine doors 45. Projectiles of one type may be loaded in one magazine and projectiles of another type may be loaded in the other magazine.

Prior to firing, barrel 18 is turned to right or left depending on which magazine the operator desires supply barrel 18. Once the barrel 18 is in the selected position, the barrel loading port 45 for the magazine in service is opened at which time barrel 18 will accept a projectile. The projectile so loaded in barrel 18 is held from rolling out barrel 18 by retainer spring 51 (see FIG. 10).

The firing and reloading sequence is as follows: (1) trigger 28 is pulled causing gases to be introduced against piston 81; (2) piston 81 is moved forward by the gases carrying with it attached bolt 23 causing piston 81 to unseal from o-ring 82 allowing gases into barrel 18; (3) at the same time piston 81 strikes projectile (P) causing spring 51 to deform and projectile (P) to exit barrel 18; (4) gases are diverted from a portion of the forward barrel opposite the forward end of the magazine then serving the barrel into magazine passage 46; and (5) the gases so bled into the magazine urge magazine piston rearwardly which in turn urges the row of projectiles rearwardly until a projectile (P) is deposited in barrel 18 placing the weapon in its ready-to-fire mode.

In FIGS. 13–17*b,* there is shown a preferred alternative bolt and valve arrangement 91 for (1) providing gas pressure to the barrel (2) closing the intake gas valve and (3) bleeding excess gas pressure, all during the firing cycle. Bolt and valve arrangement 91 includes bolt 100, piston 116, pressure bleed valve 97 including bleed valve extension actuator 94.

Gas shutoff valve 93 includes valve seat stem 93*s,* valve pin 93*p* and valve spring 93*a.* When valve 93 is open, gas flows into main chamber 95 to charge the firearm and ready it for firing. Pressure may be in the range of 550–750 psi.

Bolt 100 has bolt lip 100*a* which is held by sear 101 in the ready to fire mode. Sear 101 pivots about pivot 101*a*. Also shown are sear return spring 103, sear break link 105, break link friction spring 106, trigger return spring 108, crank 109, trigger link 111 and trigger 112. Bolt 100 has inside surface 100*b* which reciprocates against wall 113*w* of chamber neck 113 of chamber housing 114. Both neck 113 and housing 114 are integral and stationary. Piston 116 is connected to bolt 100 at its forward end 116*f*. Bolt piston 116 rides in the inside of chamber neck 113 and reciprocates with bolt 100 to which it is attached. Within bolt piston 116 is pressure bleed valve 97 which is closed during the forward portion of the cycle of bolt 100 and is open for bleeding off pressure in main chamber 95 (including gases in chamber neck 113) during the bolt-return portion of the firing cycle.

Elongated bleed valve actuator 94 includes end 94*e* which abuts gas shutoff valve pin 93*s* and the other end abuts bleed spring 97*s*. Bleed valve actuator 94 comprises three (3) tandem sections all forming a single structural element. The sections are a bleed valve sleeve body section 97*b* which abuts bleed valve spring 97*s*; a conical funnel section 97*f* and the stem section 94*s*. Bleed valve 97 further includes valve closure ring 97*c* which closes off or opens up valve intake apertures 123 (see FIG. 17*b*). Bleed valve 97 is closed when closure ring 97*c* is positioned over intake apertures 123 to prevent gas under pressure from entering (see FIGS. 17*a*, 17*b*). When closure ring 97*c* is moved to uncover apertures 123, valve 97 is open allowing gases to enter passageway 97*p* of bleed valve body 97*b* which gases exit radially positioned forward apertures 127 and flow out the barrel. Bleed valve 97 also includes ring gasket 97*g*.

Due to the high pressures utilized in operating weapon 7, there is still pressure remaining in main chamber 95 as the bolt piston 116 travels during its return stroke and reaches sealing engagement with the housing sleeve 113. It is preferable to bleed some or all of this pressure to atmosphere to allow bolt 100 to fully return.

In the operation of weapon 7 and particularly the bolt and valve arrangement 91, main chamber 95 is initially charged up to a selected pressure. At that pressure, bleed valve funnel piece 94*f* is forced forward by gas pressure compressing spring 97*s* to close bleed valve 97. This action of bleed valve actuator 94 causes a squeezing force between piston end 116*c* and funnel end surface 97*e* to be applied to closure ring 97*c* which expands ring 97*c* radially to increase the seal pressure between neck wall 113*w* and piston 116 (see FIGS. 13 and 17*a*). The greater the pressure in chamber at 95 the more leak proof is the seal.

As trigger 112 is pulled, the trigger link 11 is forced forward causing trigger return spring 108 to compress and the bell crank 109 to rotate. Rotation of bell crank 109 pulls the sear break link 105 which causes sear 101 to rotate due to the pulling of the sear break link 105. The rotation of the sear 101 compresses the sear return spring 106 and after sufficient rotation, releases bolt 100.

Upon release, the bolt 100 is forced forward by gases in the main pressure chamber 95 compressing the bolt spring 100*s*. As bolt 100 continues to move forward stem section 94*s* releases spring-loaded shutoff valve piston 93*p* which in turn causes gas shutoff valve pin 93*p* to engage seat 93*s* preventing additional gas from entering main pressure chamber 95 during the firing cycle. Further forward movement of bolt 100 causes piston 116 to reach a recessed area 116*a* on sleeve wall 116*w* allowing the gases in the main pressure chamber 95 to flow around piston 116 launching projectile (P) down the barrel (see arrows A, $A_1$ in FIG. 14).

As the pressure in the chamber 95 reaches a lesser value (i.e., 250 psi), forces acting on bleed valve spring 97*s* are sufficiently reduced to move valve actuator 94 rearward to open the pressure bleed valve 97 to commence bleeding of pressure. At about this point in time, the force of compressed bolt spring 100*s* causes bolt 100 to start its return and by the time bolt piston 116, during such return, comes into sealing engagement with housing sleeve 113, pressure has been bled down to 100 psi or less. Movement of actuator 94 rearwardly permits closure seal 97*c* to move forward and downwardly along tapered relief surface 98 thus relaxing closure seal 97*c* (see FIGS. 15 and 15*a*). This relaxation of seal 97*c* removes virtually all friction between wall 116*w* and seal 97*c* as bolt 100 returns. During continued rearward movement of its sear-arrested position, a sufficient amount of gases remaining in the main pressure chamber 95 are released through the now open pressure bleed valve 97 to permit bolt spring 100*s* to return bolt 100 to its sear 101.

Returned bolt 100 also causes end 94*e* of the pressure bleed valve 24 to strike the gas shutoff valve piston 93*p* causing a recharging of the main pressure chamber 95 with gas. As the pressure in the chamber 95 increases, actuator 24 the bleed valve spring 97*s* compresses closing pressure bleed valve 97. Increased pressure against conical section 94*f* causes the closure seal 97*c* to be squeezed into oval shape thus increasing the sealing force on bolt piston 116.

We claim:

1. A gas powered weapon comprising (a) a receiver;

(b) a gas chamber in the receiver;

(c) a stationary bore guide in the receiver;

(d) a bolt assembly slidably mounted along the stationary guide, such bolt assembly in turn comprising:

i) a reciprocal bolt for forward and return movement, said bolt having a forward stop wall ii) a piston fixed to the bolt for reciprocal movement with the bolt; the piston in turn comprising a) a stem, b) a restraint section, and c) valve means in the piston for permitting gas remaining in the gas chamber to escape to atmosphere during return of the bolt the bolt stop wall positioned and sized to engage the piston restraint section to prevent the piston from exiting the weapon; and the valve means permitting gas to escape during such bolt return.

2. A bolt, housing and valve arrangement for a gas operated weapon having a barrel and a projectile to be propelled down such barrel comprising a pressurized gas chamber in a rearward portion of the housing;

a bolt in a forward portion of the housing which bolt is reciprocated from a rearward sealed position in which no gas communicates with the barrel to a forward unsealed position in which gas passes from the gas chamber to the barrel;

a sear for releasably engaging the bolt;

piston means within the bolt upon which the pressurized gas acts to move the bolt forward when released;

means for returning the bolt rearwardly to a sear-engaged position;

valve means positioned within the bolt piston means for permitting gas remaining in the gas chamber to escape to atmosphere during the return of the bolt to its sear-engaged position; and actuating means for opening and closing the valve means.

3. The gas operated weapon of claim 2 in which the valve means within the bolt piston means in turn comprises (a) actuating means reciprocal in the piston means;

(b) a rearward and a forward gas opening in said sleeve body;

(c) a passageway in the sleeve body connecting such forward and rearward openings;

(d) closure means on the said actuating means for closing said rearward gas opening to prevent gases passing through such rearward gas opening;

(e) a pressure surface on the actuating means so that a first pressure in the gas chamber causes the actuating means to close the closure means; and (f) valve spring means for causing the actuating means to open the closure means when a second pressure lower than the first pressure is present in the chamber.

4. The gas-operated gun of claim 3 in which the closure means includes a slideable element which is slid over the rearward opening to close the closure means and slid to the side to open the closure means.

5. The gas-operated gun of claim 3 in which the closure means is a deformable sealing element which engages such piston means and the sleeve body to provide an interference seal between such piston means and sleeve body.

6. The gas-operated gun of claim 5 in which the deformable sealing element is deformed between the actuating means and the housing to increase the interference seal between the piston means and the housing.

7. The gas-operated gun of claim 3 in which the rearward opening is a plurality of spaced-apart orifices.

8. The gas-operated gun of claim 3 in which the valve actuating means has a recess area in its exterior and the closure means is a deformable seal which moves into such recess during bolt rearward movement to reduce the interference between the housing including the chamber and the valve actuating means.

9. A gas-operated gun having a reciprocating bolt and a barrel from which projectiles are shot, comprising (a) a main chamber for holding gas under pressure in the ready-to-fire mode for shooting a projectile out the barrel;

(b) a gas supply line for supplying gas to the main chamber;

(c) a gas supply valve in the supply line which gas supply valve is open in the ready-to-fire mode;

(d) means for opening and closing the valve;

(e) a bolt extension for operating the means for closing the gas supply valve upon the firing of the sun.

10. The gas-operated gun of claim 9 in which the bolt is spring biased and is held by a sear in said ready-to-fire mode and is propelled forward by gas causing the bolt extension to cause the gas supply valve to move to its closed position.

11. The gas operated gun of claim 9 in which the bolt includes a piston which piston has a bleed valve therein and having in addition an extension bleed valve end which operates the gas supply valve.

12. The gas operated gun of claim 9 having in addition a bleed valve and in which the bolt extension is a bleed valve actuator having a surface upon which chamber gases act forwardly to close the bleed valve and which bleed valve actuator is urged rearwardly by valve spring means whereby movement of the bleed valve actuator depends on the gas pressure in the chamber.

13. A valve arrangement for a gas operated gun having a pressurized chamber which valve arrangement both vents pressure from the chamber and stops further pressurization of the chamber during the operation cycle of the gun which gun includes a barrel, a housing forming such chamber, a bolt moved forward by gas pressure to open the chamber for gases to propel a projectile down the barrel and such bolt having a rearward return means, comprising (a) intake valve means including a spring for admitting gas pressure to the chamber which intake valve means includes a valve stem urged to closed position by a spring;

(b) trigger operated means for releasing the bolt allowing such gases to move the bolt forward to permit such gases to pass the bolt to cause the projectile to be propelled;

(c) bleed valve means connected to and positioned within the bolt which bleed valve means reciprocate in the chamber housing, said bleed valve means in turn comprising a i) sleeve body mounted on the forward portion of the bolt;

ii) a bleed valve mechanism positioned within the body with such bleed valve mechanism being sized and shaped such that pressurized gases position the bleed valve means in a closed position;

iii) such bleed mechanism operating to allow the intake valve spring to close such bleed valve mechanism as the bolt is moved forward; and iv) a spring means within the bleed valve body causing such bleed valve mechanism to open during the rearward motion of the bolt.

14. The valve arrangement of claim 13 in which the bleed valve means includes orifices in the body said bleed valve mechanism being positioned over the orifices to close such valve means.

15. A bolt, housing and valve arrangement for a gas operated weapon having a barrel and a projectile to be propelled down such barrel comprising a pressurized gas chamber in a rearward portion of the housing;

a bolt in a forward portion of the housing which bolt reciprocated from a rearward sealed position in which no gas communicates with the barrel to a forward unsealed position in which gas passes from the gas chamber to the barrel;

a sear for releasably engaging the bolt;

piston means within the bolt upon which the pressurized gas acts to move the bolt forward when released;

means for returning the bolt rearwardly to a sear-engaged position;

valve means positioned in the piston means for permitting gas remaining in the gas chamber to escape to atmosphere during the return of the bolt to it sear-engaged position, actuating means for opening and closing said valve means;

said valve means in turn comprising (i) the actuating means reciprocal in the piston means;
(ii) a rearward and a forward gas opening in said actuating means;
(iii) a passageway in the actuating means connecting such forward and rearward openings;
(iv) closure means on the said actuating means for the closing rearward gas opening to prevent gases passing through such rearward opening;
(v) a pressure-receiving surface on the actuating means so that first pressure in the gas chamber causes the actuating means to close the closure means; and
(vi) valve spring means for causing the actuating means to open the closure means when a second pressure lower than the first pressure is present in the chamber.

16. The gas-operated gun of claim 15 in which the closure means includes a slideable element which is slid over the rearward gas opening to close the closure means and slides to open the closure means.

17. The gas-operated gun of claim 15 in which the closure means is a deformable sealing element which engages such piston means and the sleeve body to provide an interference seal between such piston means and sleeve body.

18. The gas-operated gun of claim 17 in which the deformable sealing element is deformed between the actuating means and the housing to increase the interference seal between the piston means and the housing that includes the chamber.

19. The gas-operated gun of claim 15 in which the rearward opening is a plurality of spaced-apart orifices.

20. The gas-operated gun of claim 15 in which the valve means sleeve body has a recess area in its exterior and the deformable seal moves into such recess during bolt rearward movement to reduce the interference between the housing including the chamber and the sleeve body.

* * * * *

UNITED STATES PATENT AND TRADEMARK OFFICE
CERTIFICATE OF CORRECTION

PATENT NO. : 5,954,043

DATED : September 21, 1999

INVENTOR(S) : Wayne R. Mayville and Thomas E. Wergen

It is certified that error appears in the above-identified patent and that said Letters Patent is hereby corrected as shown below:

Column 1, line 6, "U.S. patent" should read --pending U.S. patent--.

Column 7, line 59, "sun" should read --gun--.

Signed and Sealed this

Twenty-fifth Day of July, 2000

*Attest:*

*Attesting Officer*

Q. TODD DICKINSON

*Director of Patents and Trademarks*